US010605120B2

(12) United States Patent
Quennehen et al.

(10) Patent No.: US 10,605,120 B2
(45) Date of Patent: Mar. 31, 2020

(54) TURBINE RING ASSEMBLY THAT CAN BE SET WHILE COLD

(71) Applicant: SAFRAN AIRCRAFT ENGINES, Paris (FR)

(72) Inventors: Lucien Henri Jacques Quennehen, Paris (FR); Sebastien Serge Francis Congratel, La Brosse Montceaux (FR); Clement Jean Pierre Duffau, Paris (FR); Nicolas Paul Tableau, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 143 days.

(21) Appl. No.: 15/715,684

(22) Filed: Sep. 26, 2017

(65) Prior Publication Data

US 2018/0087405 A1 Mar. 29, 2018

(30) Foreign Application Priority Data

Sep. 27, 2016 (FR) ..... 16 01414

(51) Int. Cl.
*F01D 25/24* (2006.01)
*F01D 11/08* (2006.01)
(Continued)

(52) U.S. Cl.
CPC ..... *F01D 25/246* (2013.01); *F01D 25/12* (2013.01); *F01D 11/08* (2013.01); *F01D 11/18* (2013.01);
(Continued)

(58) Field of Classification Search
CPC ..... F01D 9/04; F01D 9/041; F01D 25/246; F01D 25/12; F01D 11/08; F01D 11/18;
(Continued)

(56) References Cited

U.S. PATENT DOCUMENTS 8,790,067 B2 * 7/2014 McCaffrey ..... F01D 11/18 415/1
2005/0129499 A1 6/2005 Morris et al.
(Continued)

FOREIGN PATENT DOCUMENTS

EP 2 434 106 A2 3/2012
GB 2565007 A * 1/2019 ..... F01D 5/186
WO WO 2015/191169 A1 12/2015

OTHER PUBLICATIONS

French Preliminary Search Report dated Jul. 12, 2017 in French Application 16 01414, filed on Sep. 27, 2016 (with English Translation of Categories of cited documents).

*Primary Examiner* — Igor Kershteyn
(74) *Attorney, Agent, or Firm* — Oblon, McClelland, Maier & Neustadt, L.L.P.

(57) ABSTRACT

A turbine ring assembly comprises a plurality of ring sectors made of ceramic matrix composite material forming a turbine ring and a ring support structure including first and second annular flanges. In section, each ring sector presents a K-shape having an annular base-forming portion with an inside face defining the inside face of the turbine ring and an outside face with first and second S-shaped tabs projecting therefrom. The inside faces of the first and second tabs of each ring sector rest on holder elements secured to the first and second annular flanges, while the outside faces of the first and second tabs are in contact with clamping elements secured to the ring support structure.

13 Claims, 4 Drawing Sheets

(51) Int. Cl.
*F01D 25/12* (2006.01)
*F01D 11/18* (2006.01)

(52) U.S. Cl.
CPC .... *F05D 2220/32* (2013.01); *F05D 2230/642* (2013.01); *F05D 2240/11* (2013.01); *F05D 2250/75* (2013.01); *F05D 2260/30* (2013.01); *F05D 2260/31* (2013.01); *F05D 2260/37* (2013.01); *F05D 2300/50212* (2013.01); *F05D 2300/6033* (2013.01)

(58) Field of Classification Search
CPC ..... F05D 2220/32; F05D 2230/642; F05D 2240/11; F05D 2250/75; F05D 2260/30; F05D 2260/31; F05D 2260/37; F05D 2300/50212; F05D 2300/6033
USPC ..... 415/170.1
See application file for complete search history.

(56) References Cited

U.S. PATENT DOCUMENTS

2012/0027572 A1* 2/2012 Denece ..... F01D 9/04 415/127
2012/0076650 A1 3/2012 Akiyama et al.
2012/0156029 A1* 6/2012 Karafillis ..... F01D 9/02 415/213.1
2012/0237342 A1* 9/2012 Berche ..... F01D 11/005 415/174.1
2014/0186152 A1 7/2014 McCaffrey et al.
2018/0051581 A1* 2/2018 Quennehen ..... F01D 11/08
2018/0051590 A1* 2/2018 Tableau ..... F01D 11/005
2018/0051591 A1* 2/2018 Quennehen ..... F01D 11/005
2018/0073398 A1* 3/2018 Quennehen ..... F01D 25/246
2018/0087401 A1* 3/2018 Quennehen ..... F01D 25/12
2018/0142572 A1* 5/2018 Quennehen ..... F01D 25/246

* cited by examiner

TURBINE RING ASSEMBLY THAT CAN BE SET WHILE COLD

BACKGROUND OF THE INVENTION

The field of application of the invention lies in particular in gas turbine aeroengines. Nevertheless, the invention is applicable to other turbine engines, for example industrial turbines.

Ceramic matrix composite (CMC) materials are known for conserving their mechanical properties at high temperatures, which makes them suitable for constituting hot structural elements.

In gas turbine aeroengines, both improving efficiency and also reducing certain polluting emissions lead to seeking operation at ever higher temperatures. For turbine ring assemblies that are made entirely out of metal, it is necessary to cool all of the elements of the assembly, and in particular the turbine ring, which is subjected to very hot streams, typically at temperatures higher than can be withstood by the metal material. Such cooling has a significant impact on the performance of the engine since the cooling stream that is used is taken from the main stream through the engine. In addition, the use of metal for the turbine ring limits the potential for increasing temperature in the turbine, even though such an increase would make it possible to improve the performance of aeroengines.

Furthermore, a metal turbine ring assembly deforms under the effect of high temperature streams, thereby modifying clearances in the flow passage and consequently modifying the performance of the turbine.

That is why using CMCs for various hot parts of engines has already been envisaged, particularly since CMCs present the additional advantage of density that is lower than the density of the refractory metals traditionally used.

Thus, making turbine ring sectors as single pieces out of CMC is described in particular in Document US 2012/0027572. Each ring sector comprises an annular base having an inside face that defines the inside face of the turbine ring and an outside face from which there extend two tab-forming portions, with the ends of the tabs being engaged in housings in a metal ring support structure.

The use of CMC ring sectors makes it possible to reduce significantly the amount of ventilation that is needed for cooling the turbine ring. Nevertheless, keeping the ring sectors in position remains a problem, in particular in the face of the differential expansions that can occur between the metal support structure and the ring sectors made of CMC. Specifically, during expansion of the metal support structure, it is important to ensure that the structure does not impose movements or forces on the CMC ring sectors that are too great, since which would run the risk of damaging them. That is why it is necessary to make provision for some minimum amount of clearance between the assembled-together parts. Unfortunately, such clearance means that it is not possible to have good control over the shape of the flow passage nor good behavior of the ring sectors in the event of making contact with the tips of the turbine blades. Furthermore, the presence of such clearance gives rise to problems of vibration.

OBJECT AND SUMMARY OF THE INVENTION

The invention seeks to avoid such drawbacks, and for this purpose it proposes a turbine ring assembly comprising both a plurality of ring sectors made of ceramic matrix composite material together forming a turbine ring and also a ring support structure including first and second annular flanges, the ring support structure being made of a material having a coefficient of thermal expansion that is greater than the coefficient of thermal expansion of the ceramic matrix composite material of the ring sectors, each ring sector presenting in section on a plane defined by an axial direction and a radial direction of the turbine ring a K-shape having a portion forming an annular base with, in the radial direction of the turbine ring, an inside face defining the inside face of the turbine ring and an outside face from which there extend first and second S-shaped tabs, the tabs of each ring sector being held between the two annular flanges of the ring support structure, the assembly being characterized in that the face of the first tab of each ring sector that faces inwards in the radial direction of the turbine ring rests on first and second holder elements secured to the first annular flange, the face of said first tab of each ring sector that faces outwards in the radial direction of the turbine ring being in contact with first and second clamping elements secured to the ring support structure, the first and second clamping elements respectively facing the first and second holder elements in the radial direction of the turbine ring, and in that the face of the second tab of each ring sector that faces inwards in the radial direction of the turbine ring rests on a third holder element secured to the second annular flange, the face of said second tab of each ring sector that faces outwards in the radial direction of the turbine ring being in contact with a third clamping element secured to the ring support structure, the third clamping element facing the third holder element in the radial direction of the turbine ring.

It is thus possible to hold the ring sectors without clearance when they are assembled cold with the ring support structure, the ring sectors being held firstly by contact between the inside faces of the tabs of the ring sectors and the holder elements secured to the annular flanges of the ring support structure, and secondly by contact between the outside faces of the tabs of the ring sectors and the clamping elements secured to the ring support structure.

In a first particular aspect of the turbine ring assembly of the invention, the first and second holder elements secured to the first annular flange are present in the vicinity of the circumferential ends of each ring sector, while the third holder element secured to the second annular flange is present in the vicinity of the middle portion of each ring sector. This ensures that each ring sector is held in balanced manner while having an overall bearing area on the ring sectors that is significantly small, thus making it possible to reduce the weight of the turbine ring assembly and to reduce the zones where stresses might be applied to the ring sectors during thermal expansion.

According to a particular characteristic of the turbine ring assembly of the invention, the first, second, and third clamping elements are formed respectively by first, second, and third pegs secured to the ring support structure. The pegs may in particular be screw-fastened or interference-fitted in the ring support structure in order to hold them in position.

In a second particular aspect of the turbine ring assembly of the invention, the face of the second tab of each ring sector that faces inwards in the radial direction of the turbine ring also rests on a fourth holder element secured to the second annular flange, the face of said second tab of each ring sector that faces outwards in the radial direction of the turbine ring being in contact with a fourth clamping element secured to the ring support structure, the fourth clamping element facing the fourth holder element in the radial direction of the turbine ring, and the first and second holder elements secured to the first annular flange and the third and fourth holder elements secured to the second annular flange are present in the vicinity of the circumferential ends of each ring sector.

Under such circumstances, balanced holding of each ring sector is likewise ensured, while having an overall bearing area on the ring sectors that is significantly small, thus making it possible to reduce the weight of the turbine ring assembly and to reduce the zones where any stresses might be applied to the ring sectors during thermal expansion.

According to a particular characteristic of the turbine ring assembly of the invention, the first, second, third, and fourth clamping elements are formed respectively by first, second, third, and fourth pegs secured to the ring support structure. The pegs may in particular be screw-fastened or interference-fitted in the ring support structure in order to hold them in position.

According to a third particular aspect of the turbine ring assembly of the invention, the first and second tabs of each ring sector extend in a rectilinear direction, while the annular base of each ring sector extends in the circumferential direction of the ring. Thus, the ring presents bearings in rectilinear manner at its contact with the ring support structure. This makes it possible to have well-controlled sealing zones.

In a fourth particular aspect of the turbine ring assembly of the invention, the contact zones between the holder elements and the tabs lie in a common rectilinear plane, and the contact zones between the tabs and the clamping elements lie in a common rectilinear plane.

This alignment of the contact zones on parallel rectilinear planes makes it possible to retain lines of sealing in the event of the ring tilting and to conserve the same zones of contact both when cold and when hot.

In a fifth particular aspect of the turbine ring assembly of the invention, it further includes an upstream plate mounted on the first flange, the upstream plate having a plurality of first and second holder elements distributed uniformly on the face of the plate that faces the first tabs of the ring sectors. The use of a plate serves to facilitate assembling the ring sectors on the ring support structure.

In a sixth particular aspect of the turbine ring assembly of the invention, the second flange is elastically deformable. This makes it possible to avoid exerting excessive stresses on the ring sectors. Thus, axial prestress may be applied by the flanges on the ring sectors without generating excessive stresses in order to take up expansion differences between the ceramic matrix composite material of the ring sectors and the metal of the ring support structure.

In a seventh particular aspect of the turbine ring assembly of the invention, it further includes a plurality of cooling stream diffusers that are interposed between the ring support structure and the ring sectors. This makes it possible to inject and diffuse a cooling stream into the inside of the ring support structure.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
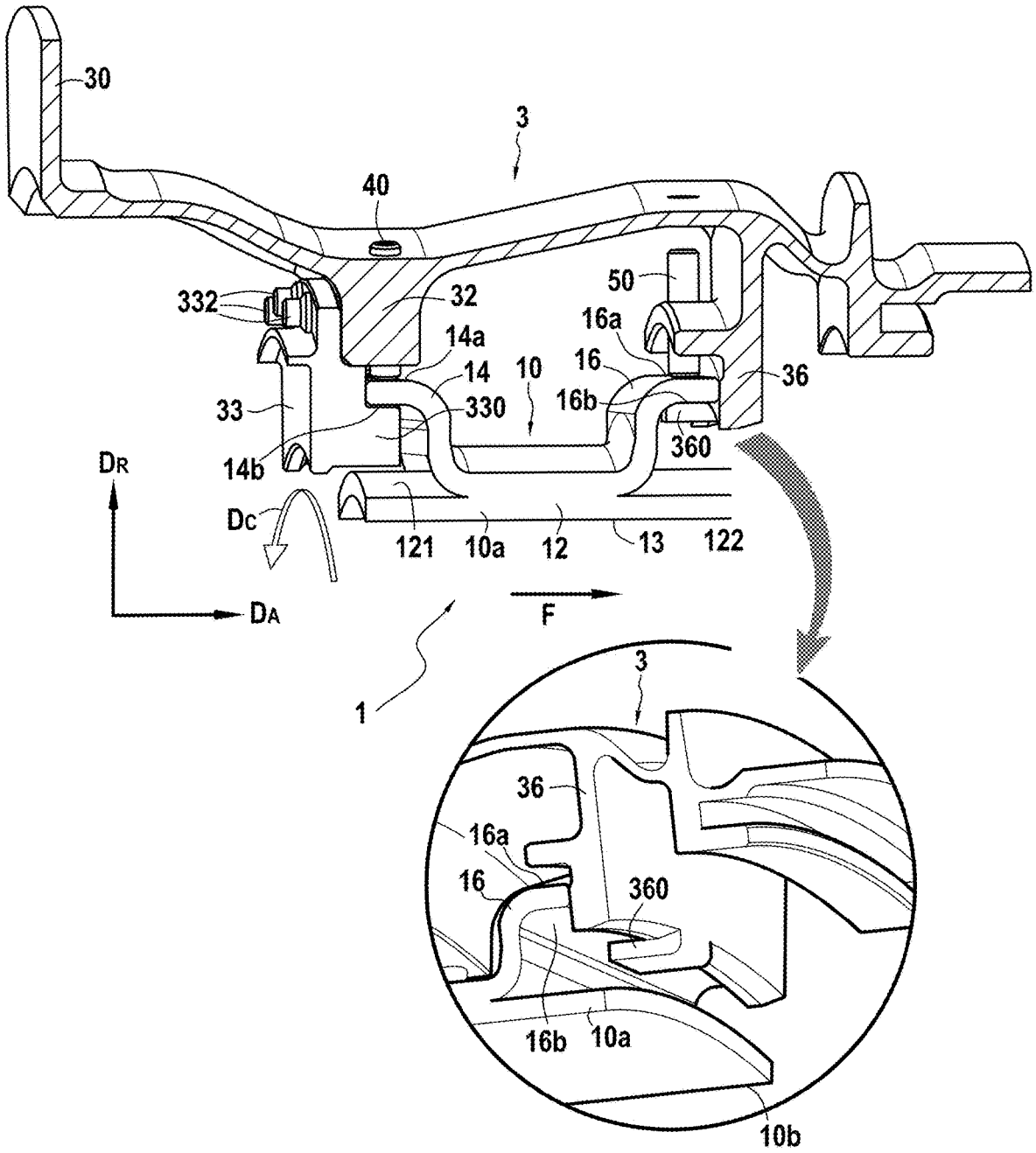
FIG. 1 is a first diagrammatic perspective view of an embodiment of a turbine ring assembly of the invention.

FIG. 1 shows a high pressure turbine ring assembly comprising both a turbine ring 1 made of ceramic matrix composite (CMC) material and also a ring support structure 3 made of metal. The turbine ring 1 surrounds a set of rotary blades (not shown). The turbine ring 1 is made up of a plurality of ring sectors 10, with FIG. 1 being a view in radial section. Arrow $D_A$ shows the axial direction of the turbine ring 1, while arrow $D_R$ shows the radial direction of the turbine ring 1.

Figure 2:
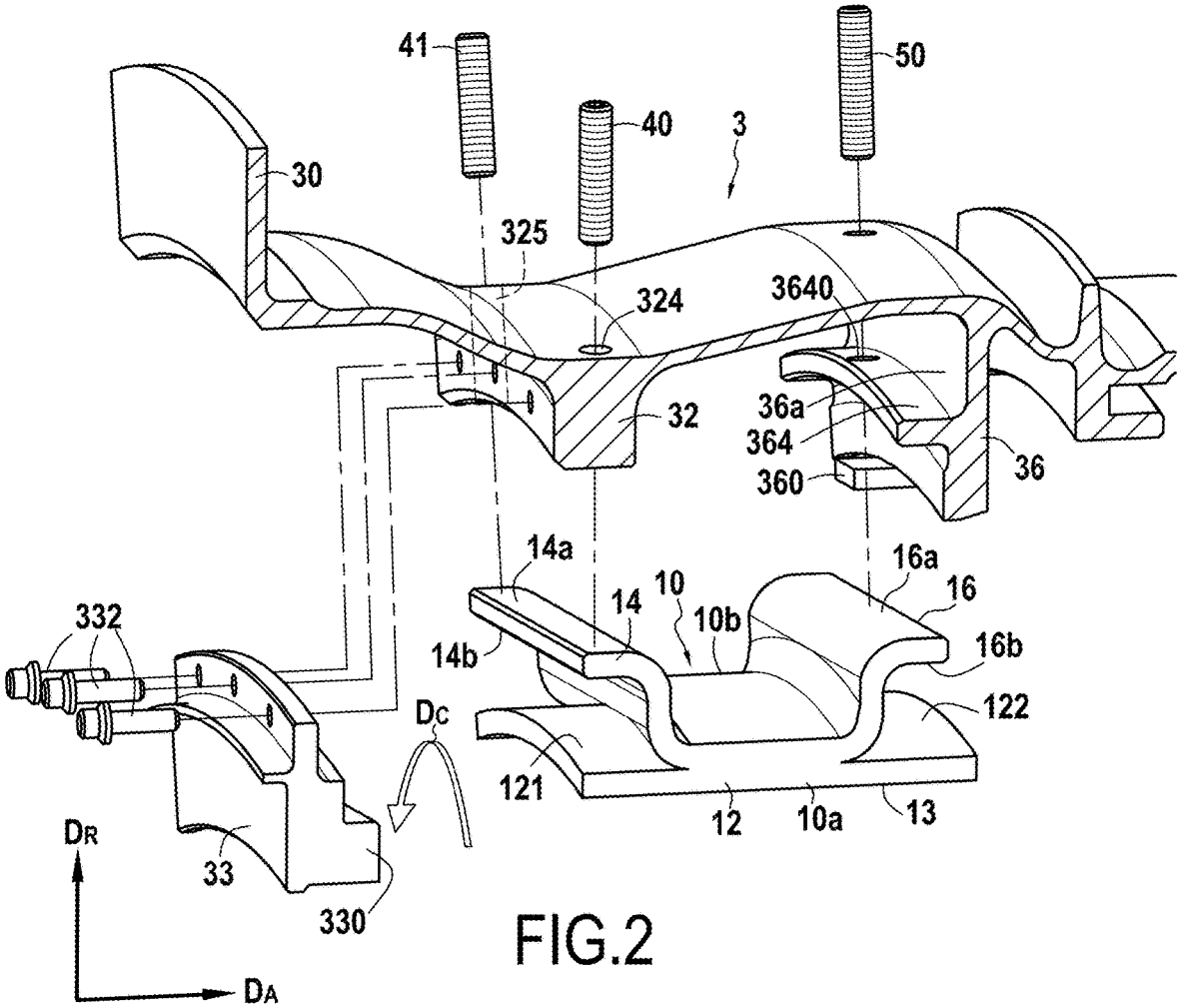
FIG. 2 is an exploded second diagrammatic perspective view of the FIG. 1 turbine ring assembly.

As shown in FIG. 2 and in a plane defined by the axial and radial directions $D_A$ and $D_R$, each ring sector 10 presents a section that is substantially K-shaped, comprising an annular base 12 having, in the radial direction $D_R$ of the ring, an inside face coated in a layer 13 of abradable material that defines the gas stream flow passage through the turbine. Upstream and downstream tabs 14 and 16 that are substantially S-shaped extend in the direction $D_R$ from the outside face of the annular base 12 over its entire width and above upstream and downstream end portions 121 and 122 of the annular base 12. The terms "upstream" and "downstream" are used herein with reference to the flow direction of the gas stream through the turbine (arrow F in FIG. 1).

The ring support structure 3, which is secured to a turbine casing 30, comprises an upstream annular radial flange 32 and a downstream annular radial flange 36 that extend both in the radial direction $D_R$ towards the center of the ring 1 and also in the circumferential direction of the ring. In the presently-described example, the ring support structure 3 also has an upstream plate 33 presenting an annular shape, the upstream plate 33 being fastened to the upstream annular radial flange 32. For reasons of clarity, FIGS. 1 and 2 show only a portion of the turbine ring 1, of the ring support structure 3, and of the plate 30, even though these elements in fact extend over the shape of a complete ring, with a plurality of adjacent ring sectors 10 being arranged between the flanges 32 and 36 of the ring support structure.

The upstream and downstream tabs 14 and 16 of each ring sector 10 extend in a rectilinear direction whereas the annular base 12 of each sector extends in the circumferential direction $D_C$ of the turbine ring 1.

Figure 3:
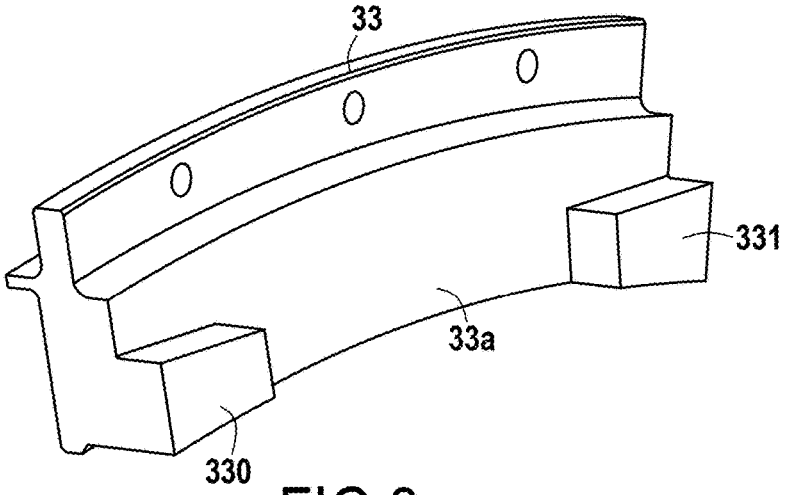
FIG. 3 is a fragmentary diagrammatic perspective view of the upstream plate of the FIG. 1 turbine ring assembly.

In the presently-described example, the face **14*b* of the first tab 14 of each ring sector 10 that faces inwards in the radial direction $D_R$ of the turbine ring rests on first and second holder elements secured to the upstream annular radial flange 32, and corresponding in this example to first and second lugs 330 and 331 projecting from the face 33*a* of the upstream plate 33 (FIG. 3) that faces towards the upstream tab 14 of each ring sector 10. The first and second lugs 330 and 331 are distributed regularly on the plate 33 at positions that are determined so as to be present in the vicinity of the circumferential ends 10*a* and 10*b* of each ring sector 10. Since the upstream plate 33 is fastened to the upstream annular radial flange 32, the lugs 330 and 331 are secured to the upstream annular radial flange 32**.

In addition, the face **14*a* of the upstream tab 14 of each ring sector 10 that faces outwards in the radial direction $D_R$ of the turbine ring 1 is in contact with first and second clamping elements secured to the ring support structure 3, in this example first and second pegs 40 and 41. The first and second pegs 40 and 41 are placed respectively facing the first and second lugs 330 and 331 in the radial direction $D_R$ of the turbine ring 1. The pegs 40 and 41 are held respectively in orifices 324 and 325 formed in the upstream annular radial flange 32. The pegs 40 and 41 may be interference-fits in the orifices 324 and 325 by using known metal-on-metal assembly techniques such as H6-P6 fits or other forced assembly techniques or by shrinking the pegs in a cold fluid (e.g. nitrogen) prior to assembly, or else they may be held in said orifices by screw-fastening, in which case the pegs 40 and 41 are threaded to co-operate with tapping formed in the orifices 324 and 325**. The pegs may also be assembled in the orifices with clearance and then welded in the orifices (by tungsten inert gas (TIG) welding, by laser melting, etc.).

The face 16*b* of the second tab 16 of each ring sector 10 that faces inwards in the radial direction $D_R$ of the turbine ring rests on a third holder element secured to the annular radial flange 36, corresponding in this example to third lugs 360 (FIGS. 1 and 2) projecting from the face 36*a* of the flange 36 facing the upstream tabs 14 of ring sectors 10. The third lugs 360 are distributed uniformly on the face 36*a* of the annular radial flange 36 in positions that are determined so as to be present in the vicinity of the middle portions of each of the ring sectors 10.

In addition, the face 16*a* of the downstream tab 16 of each ring sector 10 that faces outwards in the radial direction $D_R$ of the turbine ring 1 is in contact with a third clamping element secured to the ring support structure 3, in this example a third peg 50. The third peg 50 is placed facing the third lug 360 in the radial direction $D_R$ of the turbine ring 1. The peg 50 is held in an orifice 3640 formed in a projection 364 present on the face 36*a* of the downstream annular radial flange 36 facing the tabs 16 of the ring sectors 10. The peg 50 may be an interference-fit in the orifice 3640 using known metal-on-metal assembly techniques such as H6-P6 fits or other forced assembly techniques that enable these elements to be held together when cold, or they may be held in the orifices by screw-fastening, in which case each peg 50 has a thread that co-operates with tapping formed in the orifice 3640.

Figure 4:
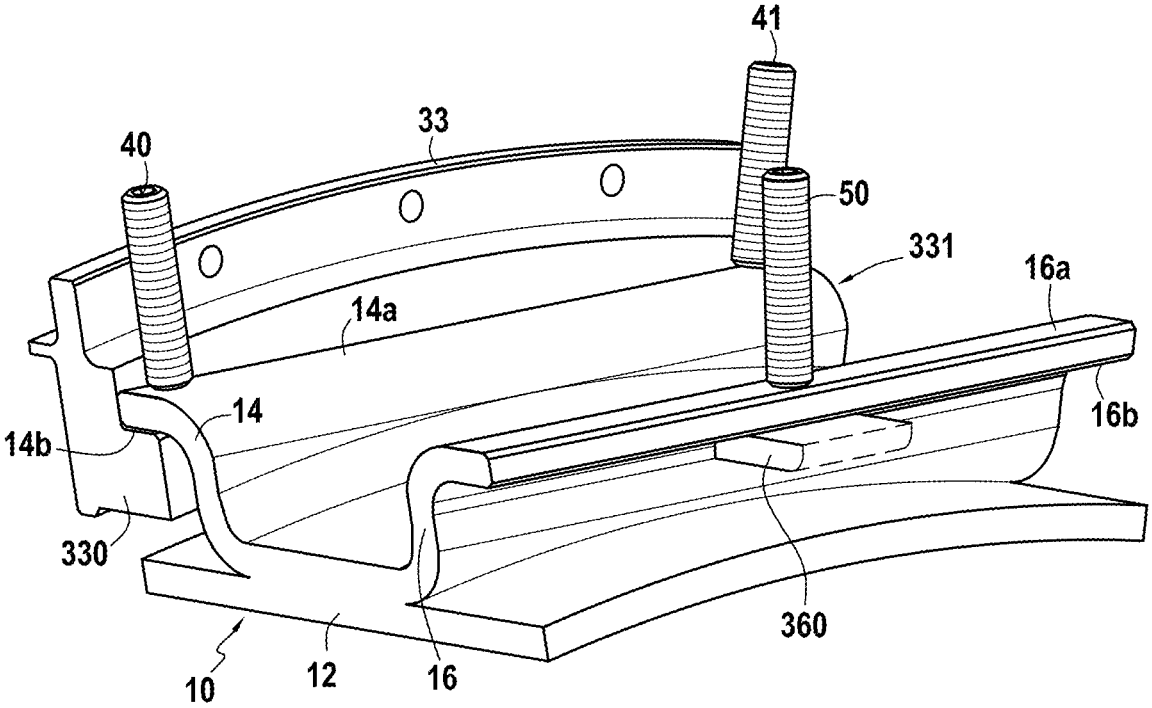
FIG. 4 is a diagrammatic perspective view showing the bearing points applied to each ring sector in the FIG. 1 turbine ring assembly.

In the presently-described example, each ring sector 10 is held in the ring support structure via three holding points, a first holding point being formed by the lug 330 and the facing peg 40, a second holding point being formed by the lug 331 and the facing peg 41, and a third holding point being formed by the lug 360 and the facing peg 50, as shown in FIG. 4.

The clamping elements, in this example the pegs 40, 41, and 50 may be made of a material presenting a coefficient of thermal expansion that is greater than the coefficient of thermal expansion of the ceramic matrix composite material of the ring sectors. By way of example, they may be made of a metal material. The clamping elements could also be made of CMC or of ceramic material.

The use of an upstream plate 33 facilitates assembling the ring sectors on the ring support structure.

Nevertheless, the turbine ring assembly of the invention could be made without an upstream plate. Under such circumstances, the upstream annular radial flange extends further down towards the center of the ring like the upstream annular radial flange, with first and second holder elements such as lugs being present directly on the upstream annular radial flange facing the upstream tabs of the ring sectors. In another variant embodiment, a plurality of first and second holder elements, such as lugs, may be present on the downstream annular radial flange, while a plurality of third holder elements, such as lugs, may be present on the upstream plate. The invention also applies to a turbine ring assembly in which a plurality of holder elements and a plurality of clamping elements are present both beside the downstream annular radial flange and beside the upstream annular radial flange.

Sealing between sectors is provided by sealing tongues received in grooves that face each other in the facing edges of two adjacent ring sectors (not shown in FIGS. 1 and 2). In conventional manner, ventilation orifices (not shown in FIGS. 1 and 2) formed in the flange 32 enable cooling air to be delivered to the outside of the turbine ring 10.

By using clamping elements, such as the pegs 40, 41, and 50, it is possible to adjust the bearing forces between the ring sectors and the ring support structure while cold. The term "cold" is used in the present invention to mean the temperature at which the ring assembly is to be found when the turbine is not in operation, i.e. an ambient temperature that may be about 25° C., for example. The term "hot" is used herein to mean the temperatures to which the ring assembly is subjected while the turbine is in operation, which temperatures may lie in the range 600° C. to 1500° C.

In the above-described example, two holder elements and two clamping elements are present beside the upstream annular radial flange, while one holder element and one clamping element are present beside the downstream annular radial flange. The invention is equally applicable to a turbine ring assembly in which two holder elements and two clamping elements are present beside the downstream annular radial flange, while one holder element and one clamping element are present beside the upstream annular radial flange.

There follows a description of a method of making a turbine ring assembly of the kind shown in FIGS. 1 and 2.

Each above-described ring sector 10 is made of ceramic matrix composite (CMC) material by forming a fiber preform having a shape close to the shape of the ring sector and densifying the ring sector with a ceramic matrix.

In order to make the fiber preform, it is possible to use yarns made of ceramic fibers, e.g. yarns made of SiC fibers such as those sold by the Japanese supplier Nippon Carbon under the name "Hi-Nicalon S", or indeed yarns made of carbon fibers.

The fiber preform is preferably made by three-dimensional weaving or by multilayer weaving with zones of non-interlinking being provided to enable the portions of the preforms that correspond to the tabs 14 and 16 of the sectors 10 to be moved outwards.

The weaving may be of the interlock type. Other three-dimensional or multilayer weaves could be used, such as for example multi-plain or multi-satin weaves. Reference may be made to Document WO 2006/136755.

After weaving, the blank may be shaped in order to obtain a ring sector preform that is consolidated and densified with a ceramic matrix, where densification may be performed in particular by chemical vapor infiltration (CVI) as is well known. Alternatively, the shaped blank may be consolidated by chemical vapor infiltration (CVI) sufficiently to be able to retain its shape, with the preform subsequently being densified by melt infiltration using liquid silicon.

The deformability of the fiber preform is advantageously used to obtain a single piece in which the base is of annular shape while the tabs are of rectilinear shape.

A detailed example of fabricating CMC ring sectors is described in particular in Document US 2012/0027572.

The structure of the ring support 3 is made out of a metal material such as a C263, Waspaloy®, or Inconel 718 alloy.

Making of the turbine ring assembly is continued by mounting the ring sectors 10 on the ring support structure 3. As shown in FIG. 2, the inside faces 16*b* of the downstream tabs 16 of each of the ring sectors are placed on the corresponding studs 360 secured to the downstream annular radial flange 36. The pegs 50 are then mounted so as to hold the downstream tabs 16 of the ring sectors 10 on the flange 36. The ring sectors may be arranged in a ring configuration outside the ring support structure, e.g. by means of spider-type tooling, and then inserted together axially into the ring support structure, with the ring sectors then being held in place radially by installing the pegs 50. The upstream plate 33 is then assembled to the upstream annular radial flange 32, the plate being fastened to the upstream annular radial flange by way of example by using clamping members 332 of the nut-and-bolt type or by brazing. The plate may also be held merely by making contact with the upstream annular radial flange, since the large aerodynamic forces that are generated in operation in the (low or high pressure) nozzle and that act thereon are transmitted to the plate, thus ensuring that the plate remains in contact with the upstream annular radial flange. Once the upstream plate 33 has been assembled in this way, the inside faces 14*b* of the upstream tab 14 of each ring sector 10 rest on the lugs 330 and 331. When cold, the way the tabs 14 and 16 of each ring sector are held without clearance between the flanges 32 and 36 of the ring support structure is adjusted by setting the positions of the pegs 40, 41, and 50. A turbine ring assembly as shown in FIG. 1 is thus obtained.

The downstream annular radial flange 36 is preferably thinned in order to be elastically deformable and avoid exerting excessive stresses on the ring sectors made of CMC. Thus, axial prestress obtained by using interference of a few tenths of a millimeter serves to take up differences of expansion between the CMC of the ring sectors and the metal of the ring support structure.

The turbine ring assembly of the invention may have more than three holding points for each ring sector as described above. The turbine ring assembly of the invention may in particular have four holding points for each ring sector, two holding points via the upstream radial flange and two holding points via the downstream radial flange. Under such circumstances, the upstream annular radial flange has a plurality of pairs of first and second holder elements, e.g. lugs, as described above, while the downstream annular radial flange has a plurality of pairs of third and fourth holder elements, e.g. lugs. The first and second holder elements and also the third and fourth holder elements are placed on the flanges at positions that are determined so as to ensure they are present in the vicinity of the circumferential ends of each ring sector. A clamping element, e.g. a peg, is placed facing each holder element so as to hold the tabs of each ring sector in contact with the holder elements.

Because of the rectilinear shape of the tabs of each ring sector, the bearing or contact zones between the holder elements (e.g. lugs) and the tabs lie in a common rectilinear plane. Likewise, the bearing or contact zones between the tabs and the clamping elements (e.g. the pegs) lie in a common rectilinear plane. In operation, the ring sectors tilt about an axis corresponding to the normal to the plane formed between the axial direction $D_A$ and the radial direction $D_R$ of the turbine ring. If the bearing zones are curvilinear, as in the prior art, then the tabs of the ring sectors are in contact with the ring support structure via one or two points only. Conversely, with rectilinear bearing zones it is possible for bearing to take place along a line, thereby improving sealing between the ring sectors and the ring support structure. This also improves the stability and the retention of the ring sectors on the ring support structure.

Figure 5:
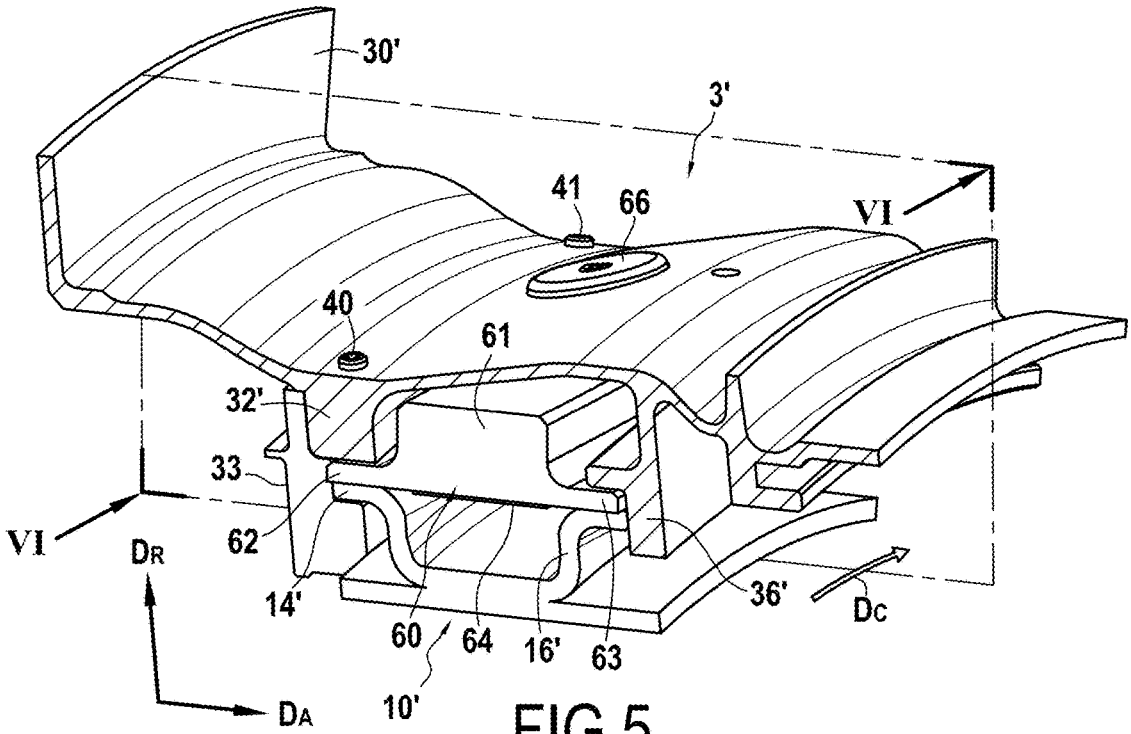
FIG. 5 is a diagrammatic perspective view of a turbine ring assembly of the invention fitted with cooling stream diffusers.
Figure 6:
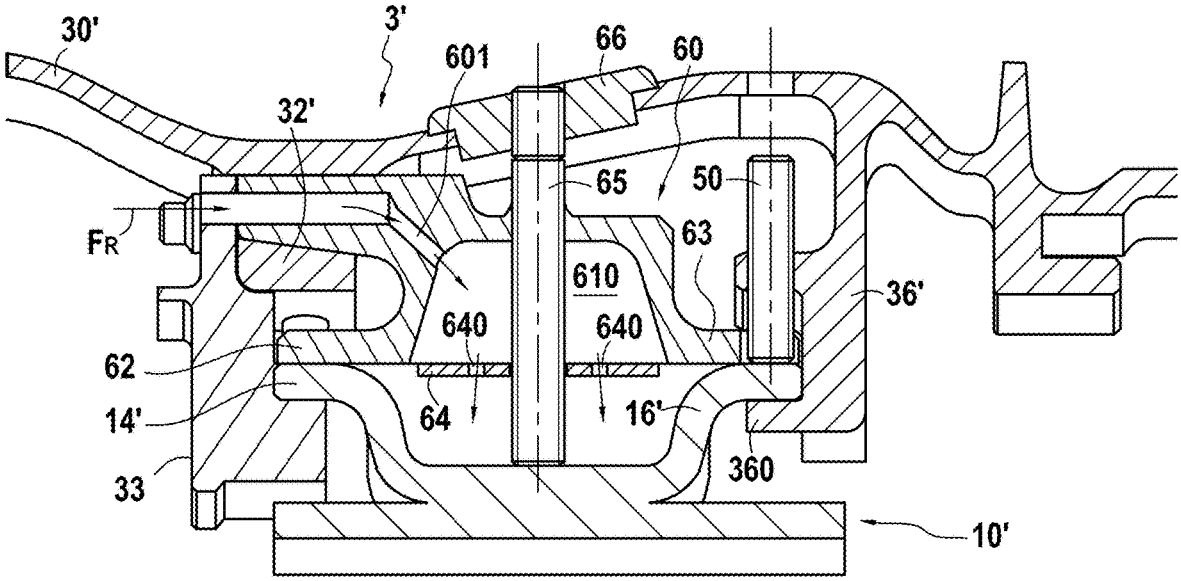
FIG. 6 is a section view of the FIG. 5 turbine ring assembly.

FIGS. 5 and 6 show another embodiment of a ring support structure that differs from the embodiment described with reference to FIGS. 1 to 4 in that it also has diffusers 60 arranged to enable a stream of cooling air to impact against the outside face of the turbine ring. Each diffuser 60 comprises a hollow body 61 defining a cavity 610. First and second tabs 62 and 63 extend from each side of the body 61, the first tab 62 being held between the upstream annular radial flange 32' of each ring support structure 3' belonging to a casing 30' and the tabs 14' of the ring sectors 10', while the second tab 63 is held between the downstream annular radial flange 36' of the ring support structure 3' and the tabs 16' of the ring sectors 10'. Each diffuser 60 is also held in position inside the ring support structure 3' by a stud 65 passing through the body 61 and secured to the ring structure 3' by a cap 66.

The cavity 610 is closed in its bottom portion by a sheet 64 having a plurality of perforations 640. A stream of cooling air $F_R$ taken from upstream in the turbine is guided into the cavity 610 by a duct 601 (FIG. 6). The stream $F_R$ then passes through the perforations 640 in the plate 64 in order to cool the outside faces of the ring sectors 10' making up the turbine ring.

The invention claimed is:

1. A turbine ring assembly comprising:

both a plurality of ring sectors made of ceramic matrix composite material together forming a turbine ring and also a ring support structure including first and second annular flanges, the ring support structure being made of a material having a coefficient of thermal expansion that is greater than the coefficient of thermal expansion of the ceramic matrix composite material of the ring sectors, each ring sector presenting in section on a plane defined by an axial direction (Da) and a radial direction (Dr) of the turbine ring a K-shape having a portion forming an annular base with, in the radial direction (Dr) of the turbine ring, an inside face defining the inside face of the turbine ring and an outside face from which there extend first and second S-shaped tabs, the tabs of each ring sector being held between the two annular flanges of the ring support structure;

wherein the face of the first tab of each ring sector that faces inwards in the radial direction of the turbine ring rests on first and second holder elements secured to the first annular flange, the face of said first tab of each ring sector that faces outwards in the radial direction of the turbine ring being in contact with first and second clamping elements secured to the ring support structure, the first and second clamping elements respectively facing the first and second holder elements in the radial direction (Dr) of the turbine ring; and wherein the face of the second tab of each ring sector that faces inwards in the radial direction of the turbine ring rests on a third holder element secured to the second annular flange, the face of said second tab of each ring sector that faces outwards in the radial direction of the turbine ring being in contact with a third clamping element secured to the ring support structure, the third clamping element facing the third holder element in the radial direction (Dr) of the turbine ring.

2. The assembly according to claim 1, wherein the first and second holder elements secured to the first annular flange are present in the vicinity of the circumferential ends of each ring sector, while the third holder element secured to the second annular flange is present in the vicinity of the middle portion of each ring sector.

3. The assembly according to claim 1, wherein the first, second, and third clamping elements are formed respectively by first, second, and third pegs secured to the ring support structure.

4. The assembly according to claim 1, wherein the face of the second tab of each ring sector that faces inwards in the radial direction of the turbine ring also rests on a fourth holder element secured to the second annular flange, the face of said second tab of each ring sector that faces outwards in the radial direction of the turbine ring being in contact with a fourth clamping element secured to the ring support structure, the fourth clamping element facing the fourth holder element in the radial direction (Dr) of the turbine ring, and wherein the first and second holder elements secured to the first annular flange and the third and fourth holder elements secured to the second annular flange are present in the vicinity of the circumferential ends of each ring sector.

5. The assembly according to claim 4, wherein the first, second, third, and fourth clamping elements are formed respectively by first, second, third, and fourth pegs secured to the ring support structure.

6. The assembly according to claim 1, wherein the first and second tabs of each ring sector extend in a rectilinear direction, while the annular base of each ring sector extends in the circumferential direction (Dc) of the ring.

7. The assembly according to claim 6, wherein the contact zones between the holder elements and the tabs lie in a common rectilinear plane and wherein the contact zones between the tabs and the clamping elements lie in a common rectilinear plane.

8. The assembly according to claim 1, further including an upstream plate mounted on the first flange, the upstream plate having a plurality of first and second holder elements distributed uniformly on the face of the plate that faces the first tabs of the ring sectors.

9. The assembly according to claim 1, wherein the second flange is elastically deformable.

10. The assembly according to claim 1, further including a plurality of cooling stream diffusers that are interposed between the ring support structure and the ring sectors.

11. A turbine ring assembly according to claim 1, wherein the first, second and third holder element are screw-fastened or interference-fitted in orifices formed in the radial direction through the turbine casing.

12. A turbine ring assembly according to claim 1, wherein the first and second holder element are screw-fastened or interference-fitted in orifices formed in the radial direction through an upstream annular radial flange, and wherein the third holder element is screw-fastened or interference-fitted is in an orifice that is formed in the radial direction through a projection present on the face of the downstream annular radial flange.

13. A turbine ring assembly comprising:

both a plurality of ring sectors made of ceramic matrix composite material together forming a turbine ring and also a ring support structure including first and second annular flanges, the ring support structure being made of a material having a coefficient of thermal expansion that is greater than the coefficient of thermal expansion of the ceramic matrix composite material of the ring sectors, each ring sector presenting in section on a plane defined by an axial direction (Da) and a radial direction (Dr) of the turbine ring a K-shape having a portion forming an annular base with, in the radial direction (Dr) of the turbine ring, an inside face defining the inside face of the turbine ring and an outside face from which there extend first and second S-shaped tabs, the tabs of each ring sector being held between the two annular flanges of the ring support structure;

wherein the face of the first tab of each ring sector that faces inwards in the radial direction of the turbine ring rests on first and second lugs secured to the first annular flange, the face of said first tab of each ring sector that faces outwards in the radial direction of the turbine ring being in contact with first and second pegs secured to the ring support structure, the first and second pegs respectively facing the first and second lugs in the radial direction (Dr) of the turbine ring; and wherein the face of the second tab of each ring sector that faces inwards in the radial direction of the turbine ring rests on a third holder lug secured to the second annular flange, the face of said second tab of each ring sector that faces outwards in the radial direction of the turbine ring being in contact with a third peg secured to the ring support structure, the third peg facing the third lug in the radial direction (Dr) of the turbine ring.

* * * * *